US006791246B2

(12) United States Patent
Niessner

(10) Patent No.: US 6,791,246 B2
(45) Date of Patent: Sep. 14, 2004

(54) SPARK PLUG AND METHOD FOR ITS MANUFACTURE

(75) Inventor: Werner Niessner, Steinheim (DE)

(73) Assignee: Beru AG, Ludwigsburg (DE)

( * ) Notice: Subject to any disclaimer, the term of this patent is extended or adjusted under 35 U.S.C. 154(b) by 7 days.

(21) Appl. No.: 10/267,041

(22) Filed: Oct. 9, 2002

(65) Prior Publication Data

US 2003/0085202 A1 May 8, 2003

(30) Foreign Application Priority Data

Oct. 9, 2001 (DE) ..... 101 49 630

(51) Int. Cl.[7] ..... H01T 13/20

(52) U.S. Cl. ..... 313/141; 313/133; 313/135; 313/142; 313/136; 123/169 EL; 445/7; 445/46; 445/49; 219/117.1

(58) Field of Search ..... 313/141, 133, 313/135, 142, 136; 445/7, 46, 49; 123/169 EL; 219/117.1, 121.63, 121.64

(56) References Cited

U.S. PATENT DOCUMENTS 5,250,778 A * 10/1993 Chiu et al. ..... 219/117.1
5,461,276 A * 10/1995 Matsutani et al. ..... 313/141
5,558,575 A * 9/1996 Chiu et al. ..... 445/7
6,215,235 B1 * 4/2001 Osamura ..... 313/141

FOREIGN PATENT DOCUMENTS

DE 38 21 688 A 1 1/1990
DE 695 02 385 T 2 10/1995
DE 198 17 391 A 1 5/2001
DE 199 22 925 A 1 2/2002
EP 0 549 368 A 2 6/1993
EP 1 049 222 A 1 11/2000

OTHER PUBLICATIONS

Patent Abstract of Japan vol. 2000, No. 14, Mar. 5, 2001 & JP 2000 306654 A (NGK Spark Plug Co Ltd), Nov. 2, 2000 *English Abstract*.

Patent Abstract of Japan vol. 017, No. 319 (E–1383), Jun. 17, 1993 & JP 05 036462 A (NGK Spark Plug Co Ltd), Feb. 12, 1993 *English Abstract*.

Patent Abstract of Japan Vo. 2000, No. 02, Feb. 29, 2000 & JP 11 329667 A (NGK Spark Plug Co Ltd), *English Abstract*.

* cited by examiner

*Primary Examiner*—Ashok Patel
*Assistant Examiner*—Holly Harper
(74) *Attorney, Agent, or Firm*—Nixon Peabody LLP; David S. Safran

(57) ABSTRACT

A method for manufacturing spark plugs with central and body electrode(s) armed with noble metal inserts, in which the tip of a central electrode which is pyramid or conic shaped with a base diameter (d), is liquefied by being pressed against a noble metal ball with diameter (d) that is mounted in the face of a welding electrode under a defined welding contact pressure and defined welding parameters. The liquefied material of the central electrode tip partially flows around the noble metal ball, and the welding electrode is separated from the central electrode after the liquefied material of the central electrode tip has solidified with noble metal ball embedded therein.

20 Claims, 2 Drawing Sheets

SPARK PLUG AND METHOD FOR ITS MANUFACTURE

BACKGROUND OF THE INVENTION

Field of the Invention

The invention relates to a method for manufacturing spark plugs with central and body electrodes armed with noble metal inserts.

SUMMARY OF THE INVENTION

A primary object of the present invention is to provide spark plugs with central and body electrodes that are armed with noble metal inserts which can be fabricated in a time-saving and economical manner with a high level of manufacturing safety.

The object according to the invention is achieved by a procedure in which a noble metal ball with diameter is mounted in the face of a welding electrode, the tip of the central electrode has a tip with a conical or pyramidal shape and is pressed onto the noble metal ball under a defined welding contact pressure and defined welding parameters for liquefying the central electrode tip, the liquefied material of the central electrode tip partially flows around the noble metal ball, and the welding electrode then is separated from the central electrode after the liquefied material of the central electrode tip has solidified about the noble metal ball.

The invention is explained in greater detail with reference to the accompanying drawings.

DETAILED DESCRIPTION OF THE INVENTION

Figure 1:
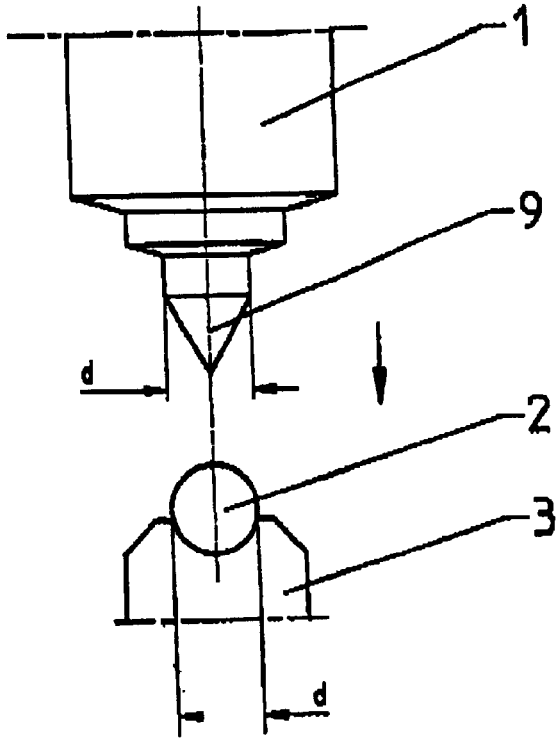
FIG. 1 is a diagrammatic longitudinal section through the tip region of a central electrode of a spark plug according to the invention, with opposed welding electrode for use in describing the method of the present invention.

In FIG. 1, the central electrode 1 of a preferred embodiment of the invention has a pyramid-shaped (conical) tip 9, wherein the base diameter of the tip 9 has diameter d. Situated opposite the tip 9 is a welding electrode 3, whose face accommodates a noble metal ball 2 made of a noble metal, e.g., iridium or an iridium alloy in its most preferred form. The ball 2 also has a diameter of d. In conventional spark plugs, the diameter d lies between 0.4 and 1.0 mm, in particular between 0.6 to 0.8 mm.

According to the invention, the noble metal ball 2 is embedded into the face of the central electrode by pressing the central electrode tip 9 onto the metal ball 2 and liquefying the tip 9 so that the material of the tip 9 flows around the portion of the noble metal ball 2 not seated in the face of the welding electrode 3; it is preferred that about half of the noble metal ball 2 be recessed in the face of the welding electrode 3.

Figure 2A:
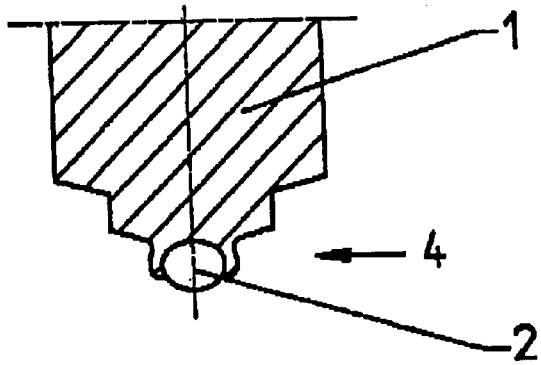
FIG. 2*a* is diagrammatic longitudinal sections through the tip area of the central electrode with an integrated noble metal ball.
Figure 2B:
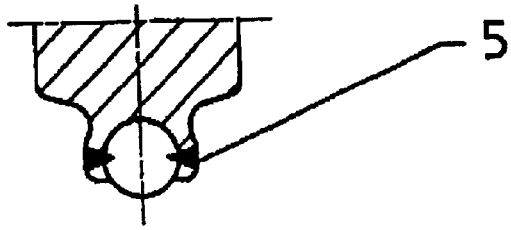
FIG. 2*b* is diagrammatic longitudinal sections through the tip area of the central electrode with an integrated noble metal ball with additional fixation of the noble metal ball via laser melting points.
Figure 3:
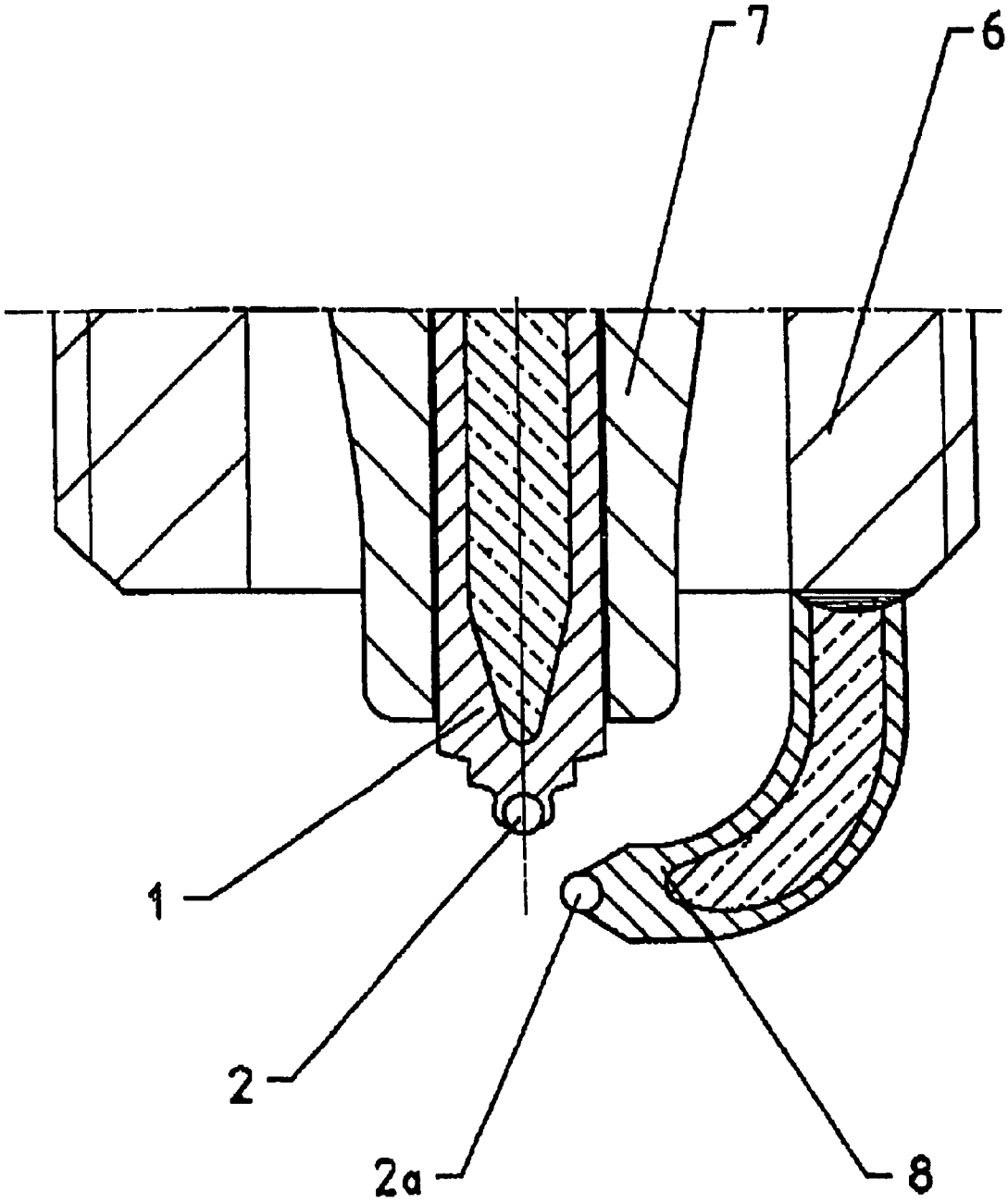
FIG. 3 is a diagrammatic longitudinal section through the tip area of a spark plug according to the invention, including body electrode.

After the material of the central electrode tip 9 has been cooled, the welding electrode 3 and central electrode 1 in which now roughly half of the noble metal ball 2 is embedded are separated. This state is shown in FIG. 2*a,* while FIG. 2*b* illustrates that the noble metal ball 2 is additionally fixed in the face of the central electrode 1 via laser melting points.

The spherical noble metal ball 2 can be incorporated into the faces of the body electrode 8 in a corresponding manner as described with respect to the central electrode.

What is claimed is:

1. A method for manufacturing spark plugs with a central and at least one body electrode and which is armed with a noble metal insert, comprising the steps of:

providing a spark plug electrode with a tip with a conical or pyramidal shape;

mounting a noble metal ball in a face of a welding electrode;

performing a welding process with the welding electrode and pressing the tip of the spark plug electrode onto the noble metal ball under a defined welding contact pressure and defined welding parameters so as to liquefy the tip of the spark plug electrode and causing the liquefied material of the tip to partially flow around the noble metal ball; and separating the welding electrode from the spark plug electrode after the liquefied material of the tip has solidified with the noble metal ball embedded therein.

2. A method according to claim 1, wherein said spark plug electrode is said central electrode.

3. A method according to claim 1, wherein said spark plug electrode is said body electrode.

4. A method according to claim 1, wherein said steps are performed for each of said central electrode and said body electrode.

5. A method according to claim 1, wherein the welding process is resistance welding process.

6. A method according to claim 4, wherein the noble metal ball is made one of iridium and an iridium alloy.

7. A method according to claim 1, wherein the noble metal ball is made one of iridium and an iridium alloy.

8. A method according to claim 7, wherein the noble metal ball is additionally fixed in the face of the electrode via laser melting points.

9. A method according to claim 4, wherein the noble metal ball is additionally fixed in the face of the electrode via laser melting points.

10. A method according to claim 1, wherein the noble metal ball is additionally fixed in the face of the electrode via laser melting points.

11. A method according to claim 7, wherein the diameter of the noble metal ball is 0.4 to 1.0 mm.

12. A method according to claim 7, wherein the diameter of the noble metal ball is 0.6 to 0.8 mm.

13. A method according to claim 4, wherein the diameter of the noble metal ball is 0.4 to 1.0 mm.

14. A method according to claim 4, wherein the diameter of the noble metal ball is 0.6 to 0.8 mm.

15. A method according to claim 1, wherein the diameter of the noble metal ball is 0.4 to 1.0 mm.

16. A method according to claim 1, wherein the diameter of the noble metal ball is 0.6 to 0.8 mm.

17. A method according to claim 1, wherein a base of the electrode has a diameter which is the same as that of the noble metal ball.

18. Spark plug manufactured using according to claim 1.

19. Spark plug manufactured using according to claim 4.

20. Spark plug comprising a central electrode and at least one body electrode and wherein at least one of said electrodes is armed with a noble metal insert, the insert being a ball of a noble metal which is embedded in a conical or pyramidal tip of the at least one electrode by metal of the tip having being liquefied against the ball and then solidified over at least half of the ball.

* * * * *